United States Patent [19]

Bjorklund

[11] Patent Number: 4,720,393

[45] Date of Patent: Jan. 19, 1988

[54] METHOD OF MANUFACTURING A LAYER WITH ELECTRICAL CONDUCTIVITY

[75] Inventor: Robert Bjorklund, Linköping, Sweden

[73] Assignee: ASEA Aktiebolag, Västerås, Sweden

[21] Appl. No.: 917,065

[22] Filed: Oct. 8, 1986

[30] Foreign Application Priority Data

Oct. 10, 1985 [SE] Sweden ..... 8504692

[51] Int. Cl.[4] ..... B05D 5/12

[52] U.S. Cl. ..... 427/58; 427/79; 427/80; 427/126.6; 427/132; 427/385.5; 427/389.7

[58] Field of Search ..... 427/58, 80, 79, 126.6, 427/132, 355.5, 389.7, 393.5, 393.6

[56] References Cited

U.S. PATENT DOCUMENTS

| | | | |
|---|---|---|---|
| 3,058,845 | 10/1962 | Hendricks | 427/80 |
| 4,460,622 | 7/1984 | Yamaoka et al. | 427/79 |
| 4,521,450 | 6/1985 | Bjorklund et al. | 427/121 |
| 4,572,843 | 2/1986 | Saito | 427/79 X |

OTHER PUBLICATIONS

Synthetic Metals, 10 (1984/85), 67–69.

*Primary Examiner*—Thurman K. Page

*Attorney, Agent, or Firm*—Watson, Cole, Grindle & Watson

[57] ABSTRACT

For the manufacture of an electrically conducting layer in the form of a coating on a base or in the form of a free bearing film, a liquid product is prepared consisting of water, a water-soluble polymer dissolved therein, a pyrrole compound dissolved in the water or present therein in undissolved state in the form of pyrrole, N-methylpyrrole or a mixture of pyrrole and N-methylpyrrole and a substance dissolved therein, such as a ferric compound, with the ability to give an electrically conducting polymerized pyrrole upon polymerization of the pyrrole compound. When the pyrrole compound in the liquid product has been transformed into a polymerized pyrrole, the liquid product is applied on a base and the water is thereafter brought to depart while leaving a layer on the base. The layer can be left as a permanent coating on the base or be removed from there while forming a free bearing film.

13 Claims, No Drawings

METHOD OF MANUFACTURING A LAYER WITH ELECTRICAL CONDUCTIVITY

BACKGROUND OF THE INVENTION

The present invention relates to a method of manufacturing a layer with electrical conductivity comprising a polymer, in which a polymerized pyrrole is anchored.

In, for example, transformers with a high direct voltage level, great differences in electrical conductivity between the oil or other used insulating fluid and the solid insulating material, such as pressboard and paper, lead to considerable problems. The solid insulating material is charged to a very considerable extent, which must be taken into consideration when dimensioning the solid insulating material and which involves considerable disadvantages. These problems could be eliminated, or in any case be considerably reduced, by the use of solid insulating materials with a suitably adapted surface conductivity. Similar problems to achieve a suitably adapted surface conductivity exist, inter alia, in connection with bushings in d.c. and a.c. insulation systems and along insulating bodies in general.

From U.S. Pat. No. 4,521,450 it is known to increase the electrical conductivity of solid impregnable materials, such as cellulose-based insulating materials, by polymerizing pyrrole or N-methylpyrrole in contact with the insulating material in such a way that the polymerized pyrrole compound becomes electrically conductive. This can be done by impregnating the insulating material, before adding the pyrrole compound, with an aqueous solution of a ferric compound or another substance with the ability to give an electrically conductive polymerized pyrrole upon polymerization of the pyrrole compound. The pyrrole compound can be supplied to the insulating material in gaseous or liquid state.

It is also known, from Synthetic Metals, 10 (1984/85), 67–69, to bring about a conductive film by the use of pyrrole. In that case a film of polyvinyl alcohol is applied to an electrode and the applied polyvinyl alcohol is heat-treated so as to become sufficiently insoluble but swellable in water. The electrode is then placed together with a second electrode in an electrolyte in the form of an aqueous solution containing pyrrole. The pyrrole is thereafter subjected to electrochemical polymerization, which takes place while the pyrrole is anchored to the film of polyvinyl alcohol.

Conducting films can also be manufactued from copolymers of isoprene and acetylene, which is clear from the J. Chem. Soc., Chem. Commun. 1984, 1347–48. In that case the conducting polymer is dissolved in an organic solvent and is cast to a film. However, the copolymer is not stable in air, so the manufacture of the film must be carried out in an inert atmosphere and the use of the film is strictly limited.

SUMMARY OF THE INVENTION

The present invention makes it possible to manufacture a conducting layer having stable properties in air on an arbitrary base layer. Thus, the base layer need not constitute an impregnable material or an electrode in an electrolytic bath. It may, for example, consist of an arbitrary surface, for example of porcelain, glass or plastic. The conducting layer is manufactured by the use of water as solvent. The electrically conducting component, the polymerized pyrrole, is formed in the aqueous solution from a monomeric compound and is thus not manufactured in a separate process in advance. The monomeric compound, as well as an added water-soluble polymer, are uniformly distributed in the aqueous solution. The conducting layer, which is manufactured from the solution, is thus given exceedingly homogeneous properties.

According to the invention, a liquid product is prepared from water, a water-soluble, preferably film-forming polymer which is dissolved in the water, a pyrrole compound which is dissolved in the water or present therein in undissolved state and is in the form of pyrrole, N-methylpyrrole or a mixture of pyrrole and N-methylpyrrole, and a substance dissolved in the water which has the ability to give an electrically conducting polymerized pyrrole upon polymerization of the pyrrole compound, and the pyrrole compound is transformed into a polymerized pyrrole, whereafter the liquid product is applied on a base and the water is brought to depart while leaving a layer on the base. The layer can be left as a permanent coating on the base or it can be removed from the base as a unitary film.

When using pyrrole as the pyrrole compound in concentrations normally required, the liquid product is a homogeneous aqueous solution, since pyrrole is then water-soluble. When using N-methylpyrrole as the pyrrole compound, the N-methylpyrrole is for the most part present as a separate phase in the water since N-methylpyrrole has little solubility in water. When using pyrrole as the pyrrole compound in larger quantity than what is soluble in water, the unsoluble part is, of course, also present as a separate phase in the water.

It has surprisingly been proved that the polymerized pyrrole, when being produced in the presence of the water-soluble polymer, remains dissolved in the water. A corresponding polymerization without the presence of a water-soluble polymer gives a polymerized pyrrole, which is insoluble. The polymerized pyrrole is anchored to the water-soluble polymer, which is probably the reason for it being retained in the solution.

The water-soluble, preferably film-forming polymer may, inter alia, be a cellulose-based polymer, such as carboxymethyl cellulose, methyl cellulose or hydroxypropyl cellulose, and further a modified starch type in the form of an ether or an acetate, polyvinyl alcohol, polyacrylamide, polyethylene oxide, polyvinyl pyrrolidene or polyethylene imine. When using cellulose-based polymers it is especially easy to remove salts from the cellulose-based polymer with polymerized pyrrole, anchored to the polymer, because the composite product becomes insoluble when being moderably heated and again soluble when the temperature is reduced.

The substance with the ability, upon polymerization of the pyrrole compound, to give an electrically conducting polymerized pyrrole consists of a substance with the ability to take up electrons from the pyrrole compound upon its polymerization. It consists preferably of a ferric compound which can be reduced to a ferrous compound, such as ferric chloride, ferric sulphate or ferric nitrate, or of a persulphate which can be reduced to a sulphate, such as ammonium, sodium or potassium persulphate.

The pH of the liquid product must in most cases be kept below 7, suitably below 5 and preferably at 1–3. Any necessary reduction of the pH can suitably be made by the addition of hydrochloric acid, sulphuric acid or nitric acid.

The conductivity of a layer produced according to the invention can be controlled with that concentration of pyrrole compound and with that concentration of the substance with the ability to give an electrically conducting polymerized pyrrole upon polymerization of the pyrrole compound which are used in the liquid compound. Another way to control the conductivity of the conducting layer is to intermix, after the polymerization of the pyrrole compound, an additional quantity of the water-soluble polymer, originally present in the liquid product, or another water-soluble polymer.

The quantity of the water-soluble, preferably film-forming polymer, added to the liquid product, suitably amounts to 0.01–10 g per 100 ml water, and preferably to 0.01–1 g per 100 ml water.

The quantity of the pyrrole compound added to the liquid product suitably amounts to 0.01–10 g per 100 ml water, and preferably to 0.1–1 g per 100 ml water.

The ratio between the number of added molecules of the pyrrole compound and the number of added molecules of the water-soluble, preferably film-forming polymer in the liquid product, suitably lies within the interval 10–10,000, and preferably within the interval 50–400.

The quantity of the substance (including any crystal water) added to the liquid product and having the ability to give an electrically conducting polymerized pyrrole upon polymerization of the pyrrole compound suitably amounts to 0.01–20 g per 100 ml water, preferably to 0.01–10 g per 100 ml water.

If the liquid product, when applying it on a base for forming a layer on the base, should contain any residual unpolymerized pyrrole compound, it will depart from the layer together with the water.

The invention will be explained in greater detail with reference to the following examples.

EXAMPLE 1

0.2 methyl cellulose with a molecular weight of 77,000, 50 ml water, the below-stated number of grams of $Fe_2(SO_4)_3.H_2O$ and 0.2 ml pyrrole are mixed with a stirrer for a period of 6 hours at room temperature. The pH of the solution is between 1.5 and 2 depending on the quantity of $Fe_2(SO_4)_3.H_2O$. During the mixing operation an electrically conducting polymerized pyrrole is formed, which is anchored to the methyl cellulose. This composite product is soluble in the water. The solution is heated to a temperature of about 65° C., whereby the composite product becomes insoluble in the water and is separated therefrom. After washing of the product with water of a temperature of 65° C., it is dissolved in room temperature water. The solution is possibly subjected to a filtration to ensure that it only contains completely soluble polymers. The solution obtained is spread out on a surface of glass and dried at room temperature while forming a 0.01 mm thick layer, which is electrically conducting. The volume resistivity of the layer is measured, after having first been subjected to drying at 50° C. The volume resistivity varies with the quantity of $Fe_2(SO_4)_3.H_2O$ used, as will be clear from the table below:

| Number of g $Fe_2(SO_4)_3.H_2O$ per 50 ml $H_2O$ | Volume resistivity ohm cm |
|---|---|
| 0 | insulation |
| 0.25 | $5 \times 10^7$ |
| 0.75 | $8 \times 10^5$ |
| 1.5 | $1 \times 10^4$ |
| 2.5 | $1 \times 10^3$ |

The measurement of the volume resistivity was carried out in this example, as well as in the other examples, by using the four point method in a conventional manner.

EXAMPLE 2

0.1 g methyl cellulose with a molecular weight of 77,000, 25 ml water, 1 g $FeCl_3.6H_2O$ and 0.3 ml N-methylpyrrole are mixed with a stirrer for a period of 8 hours at room temperature. The pH of the mixture is about 2. During the mixing an electrically conducting, polymerized pyrrole is formed, which is anchored to the methyl cellulose. This composite product is dissolved in the water. The solution is spread out on a surface of glass and dried at room temperature while forming a 0.01 mm thick layer. The dried layer is washed with ethanol. After drying of the layer at 50° C., it has a volume resistivity of $1 \times 10^5$ ohm cm.

EXAMPLE 3

0.1 g methyl cellulose with a molecular weight of 77,000, 50 ml water, 0.75 g $Fe(NO_3)_3.9H_2O$ and 0.5 ml pyrrole are mixed with a stirrer at room temperature for a period of 4 hours. The pH of the solution is about 2. During the mixing an electrically conducting, polymerized pyrrole is formed, which is anchored to the methyl cellulose. This composite product, which is soluble in water, is made free from the ferric nitrate and dissolved in pure water in the manner described in Example 1. The solution thus obtained is applied on a glass plate and treated as described in Example 1. The volume resistivity of the 0.01 mm thick layer amounts to $1 \times 10^3$ ohm cm.

EXAMPLE 4

0.1 g methyl cellulose with a molecular weight of 77,000, 50 ml water, 0.42 g $(NH_4)_2S_2O_8$ and 0.5 ml pyrrole are mixed with a stirrer for a period of 1 hour at room temperature. The pH of the solution is about 3. During the mixing, a polymerized pyrrole is formed which is anchored to the methyl cellulose. This composite product is made free from the persulphate and dissolved in pure water as described in Example 1. The solution thus obtained is applied on a base and treated as described in Example 1, with the exception that a film of polyethyleneglycol terephthalate is used as base instead of a glass plate. The volume resistivity of the 0.01 mm thick conducting layer amounts to $2 \times 10^7$ ohm cm.

EXAMPLE 5

0.2 g methyl cellulose with a molecular weight of 77,000, 50 ml water, 1.25 g $FeCl_3.6H_2O$ and 0.2 ml pyrrole are mixed with a stirrer for a period of 2 hours at room temperature. The pH of the solution is about 2. During the mixing an electrically conducting, polymerized pyrrole is formed, which is anchored to the methyl cellulose. This composite product is made free from the ferric chloride and dissolved in pure water as described in Example 1. To the solution thus obtained there are added the below-stated additional number of g of the methyl cellulose in 50 ml water. The solution thus obtained is applied on a glass plate as described in Example 1. The volume resistivity of the 0.01 mm thick conducting layer varied with the added amount of methyl cellulose according to the following table.

| Number of g of methyl cellulose additionally added | Volume resistivity ohm cm |
|---|---|
| 0 | $8 \times 10^2$ |
| 0.2 | $4 \times 10^3$ |
| 0.3 | $6 \times 10^6$ |

EXAMPLE 6

0.2 g hydroxypropyl cellulose with a molecular weight of 100,000, 50 ml 0.1M $H_2SO_4$, 0.25 g $Fe_2(SO_4)_3.xH_2P$ and 0.2 ml pyrrole are mixed with a stirrer for a period of 6 hours at room temperature. The pH of the solution is about 1.5. During the mixing an electrically conducting, polymerized pyrrole is formed, which is anchored to the hydroxypropylene cellulose. The solution is applied on a glass plate and treated as described in Example 2. The volume resistivity of the 0.01 mm thick conducting layer amounts to $1 \times 10^5$ ohm cm.

EXAMPLE 7

0.3 g polyvinyl alcohol with a molecular weight of 86,000 is dissolved in 50 ml water at 60° C. When the solution has assumed room temperature, 2.6 g $FeCl_3$ and 0.4 ml pyrrole are added, after which the solution is mixed for a period of 3 hours at room temperature. The pH of the solution is 1.8. During the mixing an electrically conducting, polymerized pyrrole is formed, which is anchored to the polyvinyl alcohol. The solution is applied on a base and treated as described in Example 2 with the exception that a 0.13 mm thick polyamide paper (Aramid paper Type 410 from E I Du Pont De Nemours, USA) is used as base instead of a glass plate. The volume resistivity of the 0.01 mm thick, conducting layer amounts to $1 \times 10^4$ ohm cm.

EXAMPLE 8

0.2 g polyacrylamide with a molecular weight of 5,000,000–6,000,000, 50 ml water, 0.25 g $(H_4N)_2S_2O_8$ and 0.2 ml pyrrole are mixed with a stirrer for a period of 6 hours at room temperature. The pH of the solution is about 3.5. During the mixing an electrically conducting, polymerized pyrrole is formed, which is anchored to the polyacrylamide. The solution is applied on a glass plate and treated as described in Example 2 with the exception that the conducting layer is washed with water instead of alcohol. The volume resistivity of the 0.01 mm thick, conducting layer amounts to $1 \times 10^6$ ohm cm.

EXAMPLE 9

0.45 g polyethylene imine with a molecular weight of 50,000–100,000 (water content 50%), 50 ml water, 1 g $FeCl_3.6H_2O$, 0.2 ml pyrrole and 0.34 g concentrated HCl are mixed for a period of 6 hours at room temperature. The pH of the solution is about 1.5. During the mixing an electrically conducting, polymerized pyrrole is formed, which is anchored to the polyethylene imine. The solution is applied on a glass plate and treated as described in Example 2. The volume resistivity of the 0.01 mm thick, conducting layer amounts to $1 \times 10^4$ ohm mm.

EXAMPLE 10

0.2 g polyethylene oxide with a molecular weight of 600,000, 50 ml water, 1 g $FeCl_3.6H_2P$ and 0.2 ml pyrrole are mixed for a period of 6 hours at room temperature. The pH of the solution is about 2. During the mixing an electrically conducting, polymerized pyrrole is formed, which is anchored to the polyethylene oxide. The solution is applied on a glass plate and treated as described in Example 2. The volume resistivity of the 0.01 mm thick, conducting layer amounts to $1 \times 10^4$ ohm cm.

EXAMPLE 11

0.2 g polyvinyl pyrrolidone with a molecular weight of 700,000, 50 ml water, 1 g $FeCl_3.6H_2O$ and 0.2 ml pyrrole are mixed for a period of 6 hours at room temperature. The pH of the solution is about 2. During the mixing an electrically conducting, polymerized pyrrole is formed, which is anchored to the polyvinyl pyrrolidone. The solution is applied on a glass plate and treated as described in Example 2. The volume resistivity of the 0.01 mm thick, conducting layer amounts to $1 \times 10^4$ ohm cm.

Instead of pyrrole and N-methylpyrrole, mixtures of pyrrole and N-methylpyrrole can be used in the above examples, for example a mixture of equal parts pyrrole and N-methylpyrrole.

I claim:

1. A method of manufacturing a layer with electrical conductivity comprising the steps of (1) providing a liquid product by mixing (a) water, (b) a water-soluble polymer, (c) a pyrrole compound selected from the group consisting of pyrrole and N-methylpyrrole and mixtures thereof, and (d) a substance which is capable of taking up electrons from the pyrrole compound during polymerization of the pyrrole compound, (2) allowing the pyrrole compound in the liquid product from step (1) to polymerize, thereby providing an aqueous solution containing water-soluble polymer with polymerized pyrrole compound anchored thereto, (3) applying the aqueous solution from step (2) onto a base to form a layer on the base, and (4) allowing the water in the layer formed in step (3) to evaporate.

2. A method according to claim 1, wherein in step (4) said layer forms a permanent coating on the base.

3. A method according to claim 1, including after step (4) the step (5) of removing said layer from the base as a unitary film.

4. A method according to claim 1, wherein said substance which is capable of taking up electrons from the pyrrole compound during polymerization of the pyrrole compound consists of a ferric compound.

5. A method according to claim 4, wherein said ferric compound is selected from the group consisting of ferric chloride, ferric sulphate and ferric nitrate.

6. A method according to claim 1, wherein said substance which is capable of taking up electrons from the pyrrole compound during polymerization of the pyrrole compound consists of a persulphate.

7. A method according to claim 1, wherein in step (1) the pH of the liquid product is maintained below 7.

8. A method according to claim 7, wherein said pH is maintained below 5.

9. A method according to claim 1, wherein said water-soluble polymer consists of a cellulose-based polymer.

10. A method according to claim 1, wherein said water-soluble polymer is film-forming.

11. A method of manufacturing a layer with electrical conductivity comprising the steps of (1) providing a liquid product by mixing (a) water, (b) a cellulose-based polymer, (c) a pyrrole compound selected from the group consisting of pyrrole and N-methylpyrrole and mixtures thereof, and (d) a substance which is capable of taking up electrons from the pyrrole compound during polymerization of the pyrrole compound, (2) allowing the pyrrole compound in the liquid product from step (1) to polymerize, thereby providing a first aqueous solution containing cellulose-based polymer with polymerized pyrrole compound anchored thereto, (3) heating the aqueous solution of step (2) so that the cellulose-based polymer with polymerized pyrrole compound anchored thereto becomes insoluble, (4) separating the insoluble cellulose-based polymer with polymerized pyrrole compound anchored thereto from the aqueous solution provided in step (3), (5) dissolving the separated insoluble cellulose-based polymer with polymerized pyrrole compound anchored thereto obtained in step (4) in water to form a second aqueous solution containing cellulose-based polymer with polymerized pyrrole compound anchored thereto, (6) applying said second aqueous solution onto a base to form a layer on the base, and (7) allowing the water in the layer formed in step (6) to evaporate.

12. A method according to claim 11, including between steps (4) and (5) the step of washing the insoluble cellulose-based polymer with polymerized polymer anchored thereto with heated water.

13. A method according to claim 8, wherein said pH is maintained at between 1 and 3.

* * * * *